US008814162B2

(12) United States Patent
Suzuki

(10) Patent No.: US 8,814,162 B2
(45) Date of Patent: Aug. 26, 2014

(54) SHEET CONVEYING APPARATUS AND IMAGE FORMING APPARATUS

(75) Inventor: Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/861,323

(22) Filed: Aug. 23, 2010

(65) Prior Publication Data

US 2011/0049792 A1 Mar. 3, 2011

(30) Foreign Application Priority Data

Aug. 31, 2009 (JP) ..... 2009-200365

(51) Int. Cl.
*B65H 9/16* (2006.01)
*B65H 5/38* (2006.01)

(52) U.S. Cl.
CPC ..... *B65H 9/166* (2013.01); *B65H 2801/06* (2013.01); *B65H 2404/611* (2013.01); *B65H 5/38* (2013.01)
USPC ..... 271/248; 271/251

(58) Field of Classification Search
USPC ..... 271/248, 251
See application file for complete search history.

(56) References Cited

U.S. PATENT DOCUMENTS 4,744,555 A * 5/1988 Naramore et al. ..... 271/251
4,919,318 A * 4/1990 Wong ..... 226/17
5,162,857 A * 11/1992 Higeta et al. ..... 399/401
5,508,796 A 4/1996 Sasame et al.
5,692,746 A * 12/1997 Herrick, Jr. ..... 271/251
5,725,319 A 3/1998 Saito et al.
2003/0075861 A1* 4/2003 Sussmeier ..... 271/251

FOREIGN PATENT DOCUMENTS

JP 2-28448 * 1/1990
JP 2002-356250 * 12/2002
JP 3882533 2/2007
JP 2009-149391 * 7/2009
JP 2009-292590 * 12/2009

OTHER PUBLICATIONS

Machine translation of Detailed Description section of JP 2009-292590.*

* cited by examiner

*Primary Examiner* — Thomas Morrison
(74) *Attorney, Agent, or Firm* — Fitzpatrick, Cella, Harper & Scinto

(57) ABSTRACT

A sheet conveying apparatus and an image forming apparatus are provided.

An upper guide opposed to a lower guide is structured as another member, and a positional relation is set such that a nip line of a pair of obliquely feeding is offset toward the lower guide with respect to a center line of a gap portion between the upper and lower guides. Accordingly, a sheet being conveyed is once guided by an inclined face of the lower guide to the upper guide, and is then caused to abut the abutting reference surface while being in sliding contact with the upper guide member. Therefore, a disadvantage that a side edge of the sheet is caught in a joint can be prevented.

6 Claims, 11 Drawing Sheets

SHEET CONVEYING APPARATUS AND IMAGE FORMING APPARATUS

BACKGROUND OF THE INVENTION

1. Field of the Invention

The present invention relates to a sheet conveying apparatus provided in an image forming apparatus such as a printer, a facsimile machine, a copying machine and a multifunction machine having combined functions thereof, and to an image forming apparatus which includes the sheet conveying apparatus.

2. Description of the Related Art

Examples of systems employed in image forming apparatuses include the electrophotographic system, the offset printing system and the inkjet system. Color image forming apparatuses employing the electrophotographic system will be described here as an example to describe the related art. Color image forming apparatuses can be mainly classified, according to structures thereof, into a tandem type in which a plurality of image forming portions are arranged in tandem and a rotary type in which a plurality of image forming portions are arranged cylindrically. Transfer systems include a direct transfer system in which a toner image is transferred directly from a photosensitive member to a sheet and an intermediate transfer system in which a toner image is once transferred to an intermediate transfer member and then to a sheet.

Among such image forming apparatuses, apparatuses targeted to the printing market of small circulation publications have been provided in recent years by taking the advantage that plates are not made in the apparatuses. However, the apparatuses have to achieve high image quality in order to be accepted in the quick printing market, and importance is put on the accuracy of an image position with respect to a sheet as one of the factors contributing to the image quality. The accuracy of an image position includes misalignment between a front surface image and a rear surface image when a two-sided image is formed. According to an analysis of the factors for the purpose of improving the accuracy of an image position with respect to a sheet, the accuracy is determined by registration in the sheet conveying direction, registration in the width direction perpendicular to the sheet conveying direction, magnification and skew feeding. Only skew feeding among these factors is difficult to correct by electrical control. For example, it is possible to correct an image position with respect to a sheet by detecting skew feeding of the sheet and forming an image which is inclined correspondingly to the skew. However, particularly in the case of a color image formed by superimposing three or four colors, if the image is inclined for each sheet, the tint will vary for each sheet due to misalignment in dot formation of the respective colors. In addition, the time is required for calculation to incline the image, which results in significant decrease in productivity. Therefore, it is desirable to deal with the skew feeding by improving the sheet conveyance accuracy (skew correction accuracy).

In the related art, there is a method of correcting skew feeding by causing a side edge of a sheet to abut a side reference guide, which is arranged along the sheet conveying direction, by an obliquely conveying roller as one of methods for correcting skew feeding of sheets. According to this method, right and left side edges of a sheet are not reversed. Accordingly, this method is advantageous in that the skew feeding can be corrected using the same reference for both the first and second faces of the sheet.

In addition, the market requires that a wide variety of materials be supported. For example, various materials such as sheets having a basis weight of 40 [g/m$^2$] or more and 350 [g/m$^2$] or less, coated sheets and film sheets are required. Here, this method is described with reference to FIG. 9. FIG. 9 is a side view illustrating a conventional obliquely feeding conveyance unit as viewed in the sheet conveying direction. When a sheet S is caused to abut an abutting reference surface 311 of an abutting reference guide portion 31, a guiding shape is also necessary to be formed in the vertical direction so that the sheet S does not escape in the vertical direction. Accordingly, the abutting reference guide portion 31 is formed to have a U-shaped cross section as illustrated in FIG. 9. Normally, a gap between an upper guide 312 and a lower guide 313 illustrated in FIG. 9 is often about twice as wide as the thickness of the thickest sheet. A sheet S is conveyed in a manner that the sheet S is pressed to the abutting reference guide portion 31 by a skew correction roller 32 and a driven roller 34 opposed to the skew correction roller 32 to correct the skew feeding of the sheet S. If the gap between the upper guide 312 and the lower guide 313 of the abutting reference guide portion 31 is too small, the conveyance resistance when a sheet S is conveyed becomes higher. If the gap is too large, on the other hand, a sheet S is buckled or forms a loop in the gap, which causes misalignment of the sheet by an amount corresponding to the buckling or the loop.

Therefore, there is proposed, for example in Japanese Patent Laid-Open No. 2002-356250, an apparatus adapted to detect the thickness of a sheet and control the gap between upper and lower guides of a reference guide portion according to the sheet thickness in order to prevent buckling or formation of a loop when sheets having different thicknesses are conveyed.

In the technique of changing the width of the gap between the upper and lower guides according to the sheet thickness, one of the upper guide and the lower guide is formed of another member from the reference guide and the upper or lower guide position is adjustable. In such a structure, the abutting reference surface 311 and the lower guide 313 are formed integrally and the upper guide 312 is formed of another member from the abutting reference surface 311 as illustrated in FIG. 10. In such a structure, however, a joint 315 of the abutting reference surface 311 and the upper guide 312 is formed vertically on an upper portion of the abutting reference surface 311 as illustrated in FIG. 10. Accordingly, if a side edge of a sheet S abuts the joint 315, the sheet S may be caught in the joint and the side edge may be damaged or cut. The damage or cut is more likely to occur particularly in a thin sheet having low stiffness (rigidity). This is because if the sheet has low stiffness, the sheet is buckled to form a loop when the sheet is caused to abut the abutting reference guide portion 31 by the skew correction roller 32, and thus the side edge of the sheet is likely to be oriented upward or downward along the extending direction of the joint 315.

In the example structure illustrated in FIG. 10, a nip line N passing through a nip portion between the skew correction roller 32 and the driven roller 34 is coincident with a center line C of the gap between the upper guide 312 and the lower guide 313 as viewed in the conveying direction, similarly to the example structure illustrated in FIG. 9. Accordingly, the sheet S is conveyed in a manner that the leading edge (side edge) thereof follows the surface of the lower guide 313 under the influence of gravity. When the sheet S abuts the abutting reference surface 311 in this state, the side edge escapes upward as illustrated in FIG. 10. At this time, since the joint 315 of the abutting reference surface 311 and the upper guide 312 extends vertically above the side edge, the side edge of the sheet is likely to be caught in the joint 315.

Normally, parameters for preventing buckling or formation of a loop depend on the stiffness of the sheet. FIG. 11 is a graph in which the relation between the sheet thickness (paper thickness) of various materials and the stiffness is plotted. It can be seen in the graph that the stiffness varies considerably among materials having the same thickness. The relation therebetween shows an exponential trend in which a thin sheet tends to have extremely low stiffness. Therefore, it is difficult to prevent buckling or formation of a loop by simply narrowing the gap between the guides for such a sheet. As described above, a side edge of a thin sheet, in particular, is likely to be caught in the joint 315 when a loop is formed, and appropriate skew correction cannot be made. Accordingly, the accuracy of the image position is lowered. In addition, when an excessive loop is formed, the sheet is buckled, which makes a jam more likely to occur.

The present invention is directed to a sheet conveying apparatus in which a side edge of a sheet, in particular a thin sheet having a low stiffness, is prevented from being damaged when the sheet is caught in a joint between a guide member and an abutting reference surface at a reference guide portion, and to an image forming apparatus which includes the sheet conveying apparatus.

SUMMARY OF THE INVENTION

The present invention provides a sheet conveying apparatus comprising a skew correction portion which corrects skew feeding of a sheet passing on a sheet conveyance path, wherein the skew correction portion includes: a reference guide portion which includes a skew correction reference surface extending in a sheet conveying direction, and a pair of guide members which are arranged above and below of the sheet conveyance path and guide a side edge of the sheet to the skew correction reference surface; and a pair of obliquely feeding rollers which obliquely feed a sheet so that a side edge of the sheet comes in sliding contact with the skew correction reference surface, either one of the pair of guide members is formed integrally with the skew correction reference surface and another of the pair of guide members is opposed to the one guide member, a positional relation of the pair of obliquely feeding rollers and the reference guide portion is set such that a nip portion of the pair of obliquely feeding rollers is offset toward the one guide member with respect to a center line of a gap portion between the pair of guide members, and the one guide member has a guiding face which guides a side edge of a conveyed sheet to the gap portion between the pair of guide members.

According to the present invention, a sheet being conveyed is once guided by the guiding face of one of guide members to the other of the guide members, and is then caused to abut the skew correction reference surface while being in sliding contact with the other guide member. Accordingly, the disadvantage that a side edge of the sheet is caught in the joint can be prevented. Therefore, the side edge of the sheet, in particular a thin sheet having a low stiffness, can be prevented from being damaged or cut when the sheet is caught in the joint.

Further features of the present invention will become apparent from the following description of exemplary embodiments with reference to the attached drawings.

DESCRIPTION OF THE EMBODIMENTS

First Embodiment

Figure 2:
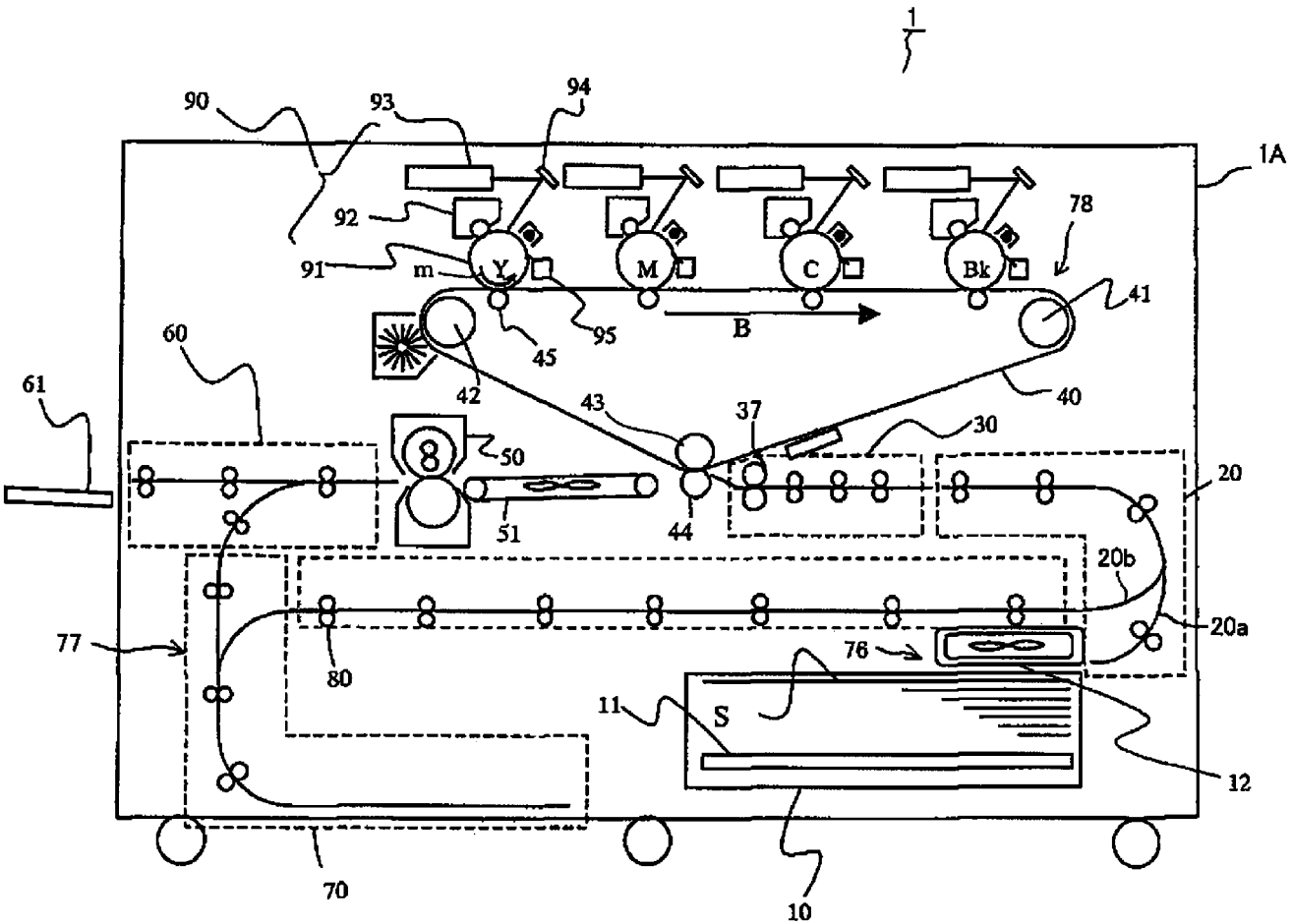
FIG. 2 is a sectional view of an image forming apparatus according to the first embodiment of the present invention.

In the following, embodiments of the present invention will be described in detail with reference to the drawings. First, general configuration of an image forming apparatus according to a first embodiment of the present invention will be generally described with reference to FIG. 2. FIG. 2 is a sectional view of a printer 1 which is an image forming apparatus according to the present invention.

As illustrated in FIG. 2, the printer 1 which is an image forming apparatus includes a printer main body 1A which is an apparatus main body. Examples of systems employed in image forming apparatuses include the electrophotographic system, the offset printing system and the inkjet system. The printer 1 illustrated in FIG. 2 is a color image forming apparatus employing the electrophotographic system. The printer 1 adopts a so-called intermediate transfer tandem system in which four color image forming units are arranged in tandem on an intermediate transfer belt 40. This system is predominant in recent years since it is excellent in supporting thick sheets (thick papers) and productivity. The printer 1 includes a skew correction device 30 which corrects skew feeding of a sheet S while conveying the sheet S. The skew correction device 30 constitutes a skew feeding portion which corrects skew feeding of a sheet passing on a sheet conveyance path. Details of the skew correction device 30 will be described later.

The printer main body 1A includes an image forming portion 90, a sheet feeding portion 76 which conveys a sheet S, a transfer portion 78 which transfers a toner image formed at the image forming portion 90 to a sheet S fed by the sheet feeding portion 76, and a sheet conveying apparatus 77 which conveys a sheet. The image forming portion 90 forms an image on a sheet S conveyed by the sheet conveying apparatus 77. The image forming portion 90 is constituted by four image forming units of yellow (Y), magenta (M), cyan (C)

and black (Bk) each including a photosensitive drum 91, an exposure device 93, a development device 92, a primary transfer device 45 and a photosensitive member cleaner 95. The colors formed by the respective image forming units are not limited to these four colors, and the order of the arrangement of the colors is not limited to the above.

The sheet feeding portion 76 includes a sheet accommodation portion 10 which accommodates sheets S in a state where the sheets S are stacked on a lifter 11, and a paper feeder 12 which feeds out a sheet S accommodated in the sheet accommodation portion 10. The paper feeder 12 may employ a system utilizing friction separation by a sheet feeding roller or a system utilizing a separation and adsorption by air. In the present embodiment, a paper feeding system utilizing air is employed as an example.

The transfer portion 78 includes the intermediate transfer belt 40 which is stretched by rollers such as a driving roller 42, a tension roller 41 and a secondary transfer inner roller 43 and driven to rotate in the direction shown by an arrow B in FIG. 2. A toner image formed on the photosensitive drum 91 is transferred to the intermediate transfer belt 40 by predetermined pressing force and electrostatic load bias applied by the primary transfer device 45. The intermediate transfer belt 40 applies the predetermined pressing force and electrostatic load bias to a secondary transfer portion formed by the secondary transfer inner roller 43 and a secondary transfer outer roller 44, which are substantially opposed to each other, so that a non-fixed image is attracted to the sheet S. The sheet conveying apparatus 77 includes a conveyance unit 20, the skew correction device 30 which includes a pair of registration rollers 37, a pre-fixing conveying portion 51, a branch conveying device 60, a reverse conveying device 70 and a duplex conveying device 80.

[Sheet Conveying Process]

In the printer 1 having the above-described structure, sheets S are accommodated in a state where the sheets S are stacked on the lifer 11 in the sheet accommodation portion 10, and are fed at an image forming timing by the paper feeder 12. A sheet S fed out by the paper feeder 12 passes on a conveyance path 21*a* of the conveyance unit 20 and is conveyed to the skew correction device 30. The sheet S is subjected to skew correction and timing correction at the skew correction device 30, and then conveyed to the secondary transfer portion. The secondary transfer portion is a nip portion which is formed by the secondary transfer inner roller 43 and the secondary transfer outer roller 44 opposed to each other and at which a toner image is transferred to the sheet S. The secondary transfer portion applies the predetermined pressing force and electrostatic load bias so that a toner image is attracted onto the sheet S.

[Image Forming Process]

Next, a forming process of an image which is conveyed to the secondary transfer portion at the same timing as the sheet S conveyed to the secondary transfer portion in the above-described conveying process will be described. Specifically, the exposure device 93 is driven based on a transmitted signal on image information and an electrostatic latent image is formed via a diffraction portion 94 on the photosensitive drum 91, the surface of which is uniformly charged in advance by a charging portion and which rotates in the direction of an arrow m in FIG. 1. The electrostatic latent image formed on the photosensitive drum 91 is subjected to toner development by the development device 92 and appears as a toner image on the photosensitive drum 91. Then, the predetermined pressing force and electrostatic load bias are applied by the primary transfer device 45 and the toner image is transferred onto the intermediate transfer belt 40. Then, transfer residual toner slightly remaining on the photosensitive drum 91 is collected by the photosensitive member cleaner 95 to prepare for the next image formation. In the image forming portion 90, only four sets of image forming units of yellow (Y), magenta (M), cyan (C) and black (Bk) are present. However, the number of colors is not limited to four, and the order of arrangement of the colors is not limited to that described in FIG. 2.

The image forming processes of the respective colors, which are processed in parallel by the image forming portion 90 corresponding to Y, M, C and Bk described above, are performed at timings that a toner image is superimposed on a toner image of the upstream color primarily transferred onto the intermediate transfer belt 40. Consequently, a full-color toner image is eventually formed on the intermediate transfer belt 40, and conveyed to the secondary transfer portion.

[Processes after Secondary Transfer]

By the above-described conveyance process of the sheet S and the above-described image forming process, the full-color toner image is secondarily transferred onto the sheet S at the secondary transfer portion. Then, the sheet S is conveyed to a fixing device 50 by the pre-fixing conveying portion 51. The fixing device 50 applies predetermined pressing force by rollers opposed to each other or a belt and, typically with a heating effect by a heat source such as a heater, fuses and fixes the toner image on the sheet S. The path of the sheet S having a fixed image thus obtained is selected whether the sheet S is discharged in this state to a discharge tray 61 by the branch conveying device 60 or conveyed to the reverse conveying device 70 when a two-sided image is to be formed.

When a two-sided image is to be formed, the leading end and the rear end of the sheet S conveyed to the reverse conveying device 70 are switched by performing a switch-back operation, then the sheet S is conveyed to the duplex conveying device 80. Then, the sheet S is timed to join sheets for subsequent jobs conveyed by the paper feeder 12 through a re-feeding path 21*b* of the conveyance unit 20 and is conveyed in the same manner to the secondary transfer portion. Since the image forming process on a rear surface (second face) is performed in the same manner as the process on the front surface (first face) described above, the description thereof will not be repeated.

Figure 1:
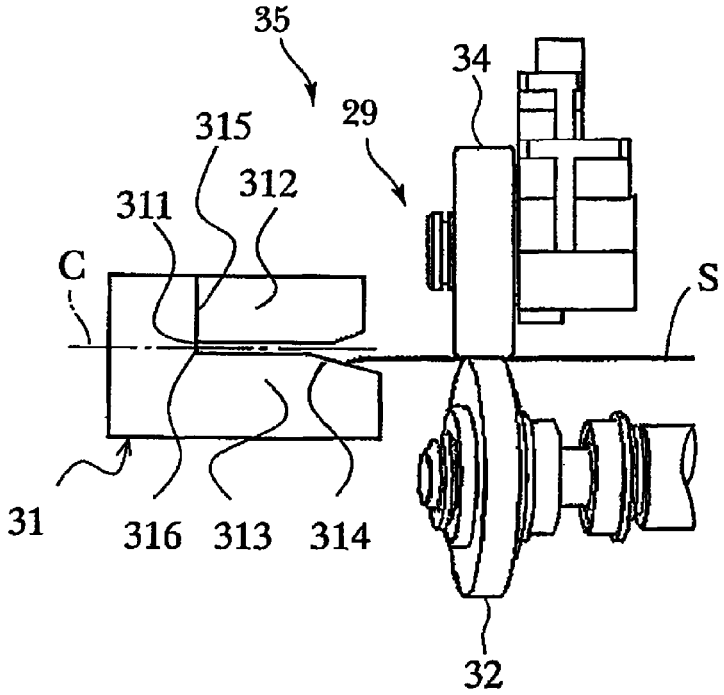
FIG. 1 is a side view illustrating a skew correction device according to a first embodiment of the present invention as viewed in the sheet conveying direction.

Next, the skew correction device 30 according to the present embodiment will be described in detail. FIGS. 3A to 3D are plan views generally illustrating the skew correction device 30 according to the present embodiment. A sequence of operations of the skew correction device 30 will be described with reference to FIGS. 3A to 3D. The skew correction device 30 is mainly constituted by parts including the pair of registration rollers 37, a movable guide portion 35, a fixed guide portion 33, skew correction rollers 32*a*, 32*b*, 32*c* and driven rollers 34*a*, 34*b*, 34*c*, which are obliquely feeding rollers. Although the driven rollers 34*a* to 34*c* are arranged to be opposed to upper portions of the skew correction rollers 32*a* to 32*c*, respectively, the driven rollers 34*a* to 34*c* are not illustrated in FIGS. 3A to 3D so that the skew correction rollers 32*a* to 32*c* are visible. In addition, while the driven roller in FIG. 1 is illustrated only with the reference number 34, the driven roller 34 is illustrated to collectively represent the driven rollers 34*a*, 34*b*, 34*c* arranged to correspond (be opposed) to the skew correction rollers 32*a*, 32*b*, 32*c*, respectively.

Figure 3A:
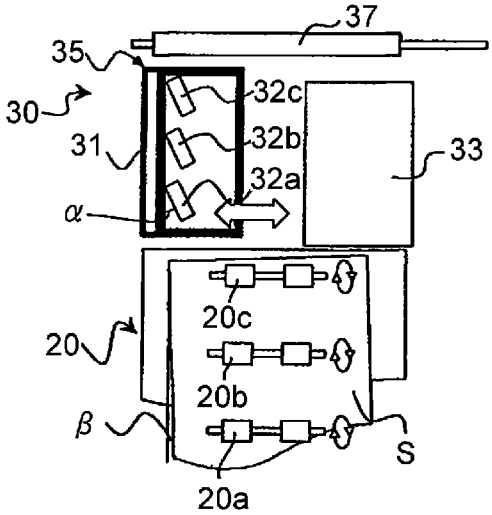
FIGS. 3A to 3D are plan views generally illustrating different sheet conveyance states of the skew correction device according to the first embodiment.

The movable guide portion 35 is arranged in a manner that the movable guide portion 35 is supported to be movable in the width direction perpendicular to the conveying direction of a sheet S depending on the size of the sheet S, and includes the abutting reference guide portion 31, the skew correction rollers 32*a*, 32*b*, 32*c* and the driven rollers 34*a*, 34*b*, 34*c*. The abutting reference guide portion 31 constitutes a reference guide portion including the abutting reference surface 311 extending in the sheet conveying direction, and the upper guide 312 and the lower guide 313 which are a pair of guide members arranged above and below a conveyed sheet S and guide a side edge of the sheet S to the abutting reference surface 311. The skew correction rollers 32*a* to 32*c* and the driven rollers 34*a* to 34*c* constitute pairs of obliquely feeding rollers 29 which adjust the position of a sheet S in the width direction so that a side edge of the sheet S comes in sliding contact with the abutting reference surface 311, which is a skew correction reference surface, with the upper and lower guides 312, 313 (see FIG. 1). As illustrated in FIG. 3A, the skew correction rollers 32*a* to 32*c* are arranged to be supported in a state inclined to the conveying direction of the sheet S at an angle α so that an abutting conveyance component to the abutting reference guide portion 31 can be obtained.

Figure 3B:
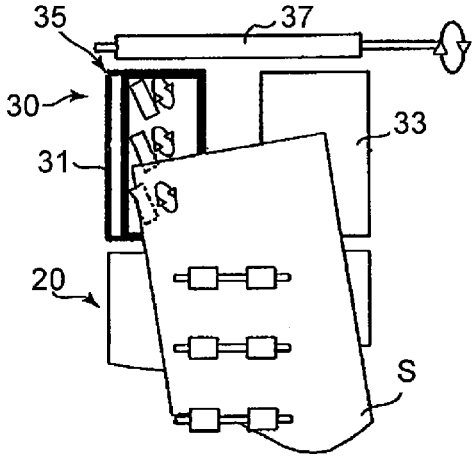

The fixed guide portion 33 is arranged to be immovably supported regardless of the size of a sheet S and functions as a conveyance guide of a sheet S. It is assumed here that a sheet S enters the skew correction device 30 at a skew angle β as illustrated in FIG. 3A. In this case, the sheet S conveyed by the conveyance unit 20 including the conveying rollers 20*a*, 20*b*, 20*c* to the skew correction rollers 32*a* to 32*c* is conveyed obliquely toward the abutting reference guide portion 31 as illustrated in FIG. 3B. When the skew correction rollers 32*a* to 32*c* start conveying the sheet S, nip portions of the conveying rollers 20*a*, 20*b*, 20*c* of the conveyance unit 20 are released with separation of the driven rollers 34*a* to 34*c* by an actuator (not illustrated).

Figure 3C:
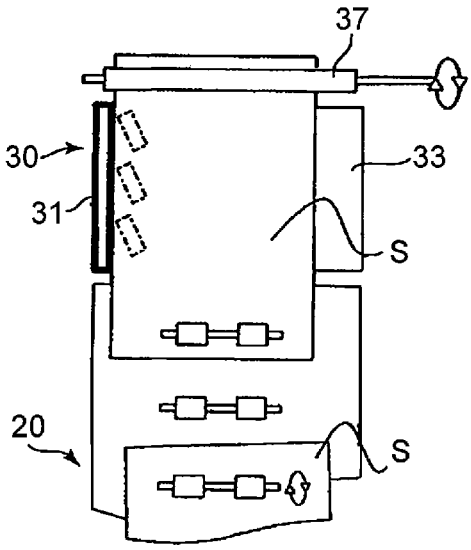
Figure 3D:
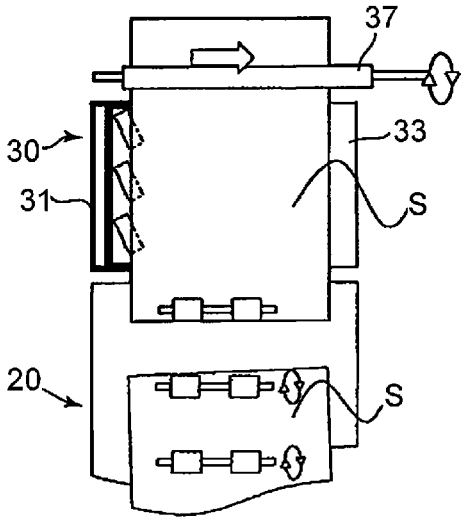

Next, the skew feeding of the sheet S is corrected while the sheet S is conveyed in a manner that the side edge of the sheet S follows the abutting reference guide portion 31, and the sheet S is nipped by the pair of registration rollers 37 in this state as illustrated in FIG. 3C. When the sheet S is nipped by the pair of registration rollers 37, the nip portions formed by the skew correction rollers 32*a* to 32*c* and the driven rollers 34*a* to 34*c* opposed thereto are released by the actuator (not illustrated). Then, the pair of registration rollers 37 are slid to move a given amount in the lateral direction (the width direction perpendicular to the sheet conveying direction) so that the sheet S is positioned at the position of the image on the intermediate transfer belt 40 as illustrated in FIG. 3D. The above-described operations are controlled by a controller (not illustrated) arranged in the printer main body 1A.

Subsequently, the movable guide portion 35 according to the present invention will be described in detail with reference to FIGS. 1, 4 to 8. The abutting reference guide portion 31, the skew correction rollers 32*a* to 32*c* and the driven rollers 34*a* to 34*c* are integrally provided in the movable guide portion 35. In the abutting reference guide portion 31, the abutting reference surface 311 and the lower guide 313 (one of the pair of guide members) are integrally formed, the angle between the abutting reference surface 311 and the upper surface of the lower guide 313 is a right angle, and thus the abutting reference surface 311 and the lower guide 313 form generally an L-shape as viewed in the sheet conveying direction. The upper guide 312 (the other of the pair of the guide members), which is opposed to the lower guide 313 and in contact with the abutting reference surface 311, is formed of another member from the abutting reference surface 311 and the lower guide 313. The upper guide 312 is arranged in a manner that one end thereof slidably abuts the abutting reference surface 311.

In the present embodiment, the abutting reference guide portion 31 is structured such that the width of a gap portion (guide plate gap) between the upper guide 312 and the lower guide 313 (that is, between guide members) can be selected from two widths of 0.5 mm and 1.0 mm. Specifically, the thickness (paper thickness) of sheets supported by the present printer 1 is about 0.05 mm to about 0.4 mm. The guide plate gap is set to 0.5 mm when the paper thickness is about 0.2 mm or less, and the guide plate gap is set to 1 mm when the paper thickness is about 0.2 mm or more. This is due to the fact that if a wide guide plate gap is used for a thin sheet, the sheet is curved to form a loop due to the wide guide gap when the sheet is caused to abut the abutting reference surface 311, which will decrease the position accuracy of the sheet. Therefore, the upper and lower guide plates are separated so that the guide plate gap can be adjusted in the present embodiment.

Since the upper and lower guide plates are formed of another member as described above, a joint 315 of the upper guide 312 and the abutting reference surface 311 is formed therebetween as illustrated in FIG. 1. When an edge (side edge) of a sheet S comes in contact with the joint 315, the side edge of the sheet S may be caught in the joint 315 and thus may be damaged or cut. Accordingly, the movable guide portion 35 of the present embodiment is structured such that a nip line N of the nip portions formed between the skew correction rollers 32*a* to 32*c* and the driven rollers 34*a* to 34*c* is not vertically coincident with a center line C of the gap portion between the upper guide 312 and the lower guide 313.

Furthermore, since the joint 315 of the upper guide 312 and the abutting reference surface 311 is above the center line C illustrated in FIG. 1, the nip line N, which is the nip portion of the pair of obliquely feeding 29 is set to be lower than the center line C. In other words, the positional relation of the pair of obliquely feeding rollers 29 and the abutting reference guide portion 31 is set such that the nip line N is offset toward the lower guide 313 (that is, toward one of the guide members) with respect to the center line C of the gap portion between the upper and lower guides 312, 313. The lower guide 313 has an inclined face 314 to facilitate entrance of a sheet S. The nip line N is set to a position which enables a side edge of a sheet to abut the inclined face 314. The inclined face 314 forms a guiding face on the lower guide 313 to guide a side edge of a conveyed sheet S to the gap portion between the upper guide 312 and the lower guide 313. Even if the upper guide 312 is moved vertically with respect to the lower guide 313 to adjust the gap portion to be wider or narrower, the center line C of the gap portion also moves vertically correspondingly. Accordingly, the positional relation still remains such that the nip line N is offset toward the lower guide 313 with respect to the center line C of the gap portion.

Figure 4:
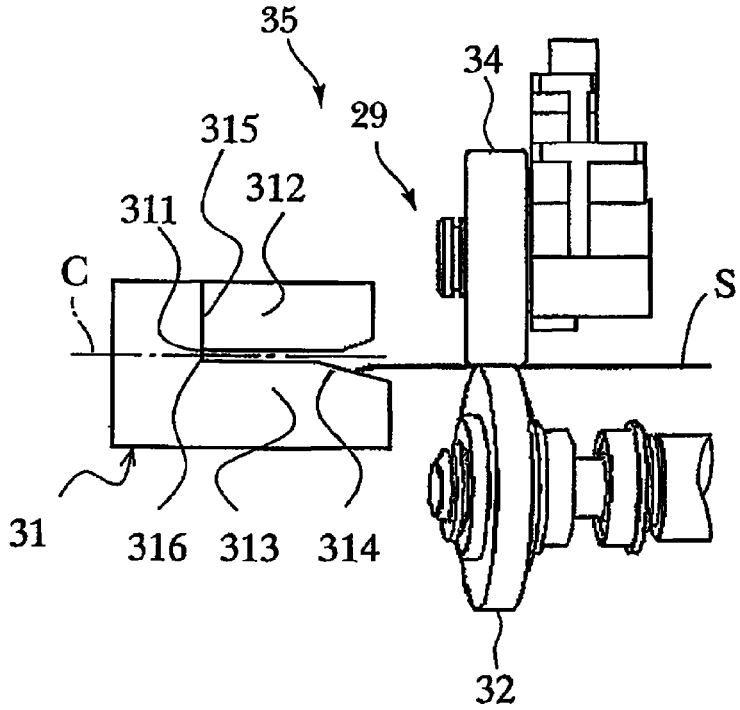
FIG. 4 is a side view illustrating a part of the skew correction device for describing behavior of a sheet when skew correction is started.
Figure 5:
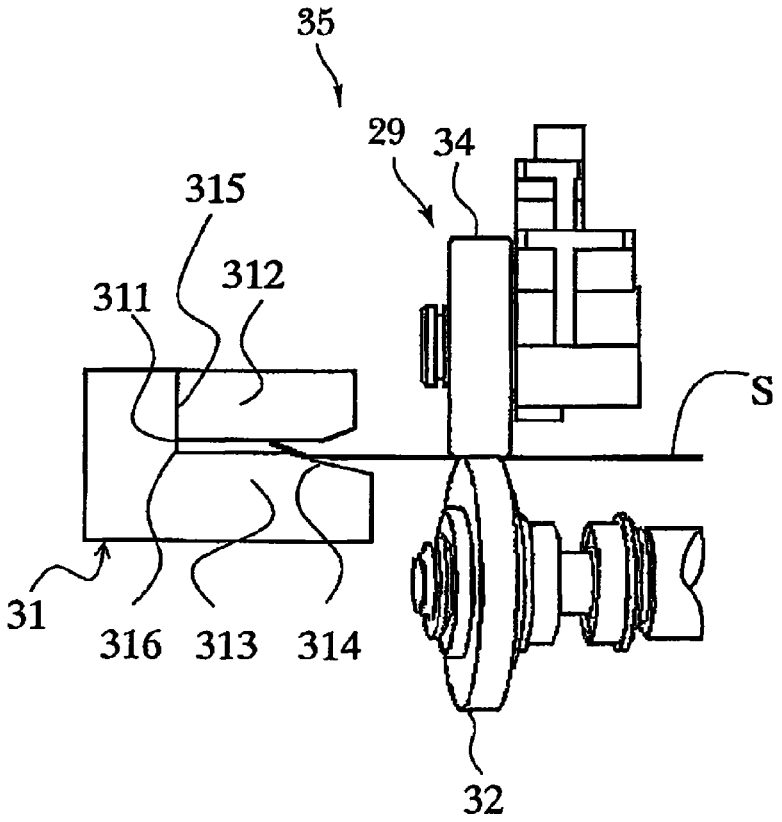
FIG. 5 is a side view illustrating a part of the skew correction device for describing behavior of a sheet after the skew correction is started.
Figure 6:
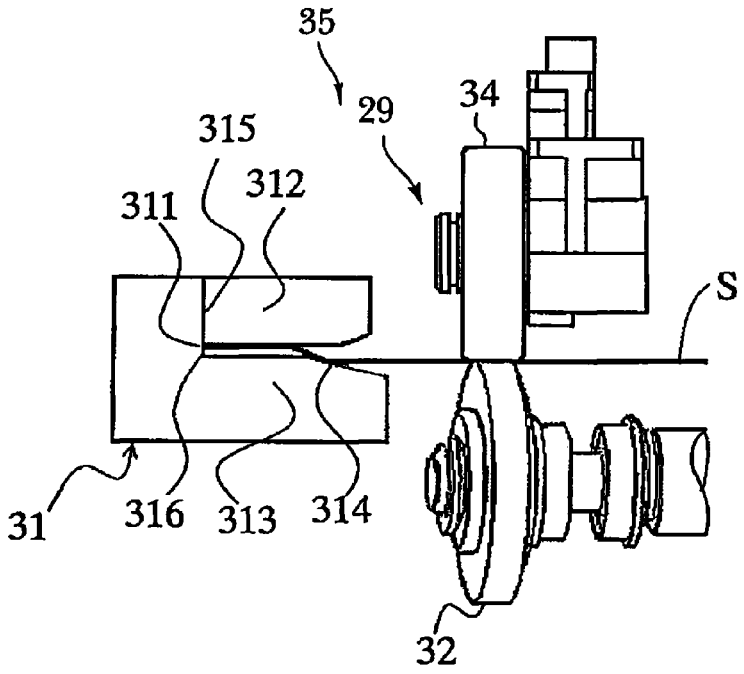
FIG. 6 is a side view illustrating a part of the skew correction device for describing additional behavior of a sheet after the skew correction is started.

Next, behavior of a sheet S when the skew correction of the sheet S is performed with the above-described structure will be described. Specifically, when the sheet S is obliquely fed by the skew correction rollers 32*a* to 32*c*, a side edge of the sheet S abuts (comes in sliding contact with) the inclined face 314 as illustrated in FIG. 4. When the sheet S is further conveyed, the moving direction of the sheet S is curved along the inclined face 314 and the sheet S is curved upward as illustrated in FIG. 5. When the sheet S is conveyed still further, the sheet S moves along the upper guide 312 and abuts the abutting reference surface 311 as illustrated in FIG. 6. At this time, since the sheet S follows the upper guide 312 and thus the side edge of the sheet S is oriented in the direction perpendicular to the joint 315, the edge is not caught in the joint 315.

Then, the skew feeding of the sheet S is corrected while being pressed to the abutting reference surface 311 and the sheet S is conveyed in the downstream direction. At this time, a sheet S having low stiffness (rigidity) is buckled while being conveyed and an edge (side edge) of the sheet moves to escape downward where there is a space, but abuts a corner portion 316 which is an intersection of the abutting reference surface 311 and the lower guide 313. As described above, since the abutting reference surface 311 and the lower guide 313 are integrally formed in the present embodiment, the sheet S is smoothly conveyed without any resistance such as a catch. While the structure in which the upper guide 312 is another member is described in the present embodiment, the lower guide 313 may alternatively be another member. In such case, it may be structured such that the nip line N is positioned on an upper side of the center line C contrary to the present embodiment.

Second Embodiment

Next, a second embodiment according to the present invention will be described with reference to FIG. 7. The second embodiment is different from the first embodiment only in the shape of the corner portion 316 and is substantially the same as the first embodiment in the remaining components. Accordingly, the same reference numbers are allotted to the same components and the description thereof will not be repeated. In the first embodiment, the structure in which a side edge portion of a sheet S is not caught in an abutment portion of the abutting reference surface 311 and the upper guide 312 is described. In the second embodiment, a structure to ensure that a sheet S is less likely to be in contact with the joint 315 will be described.

Figure 7:
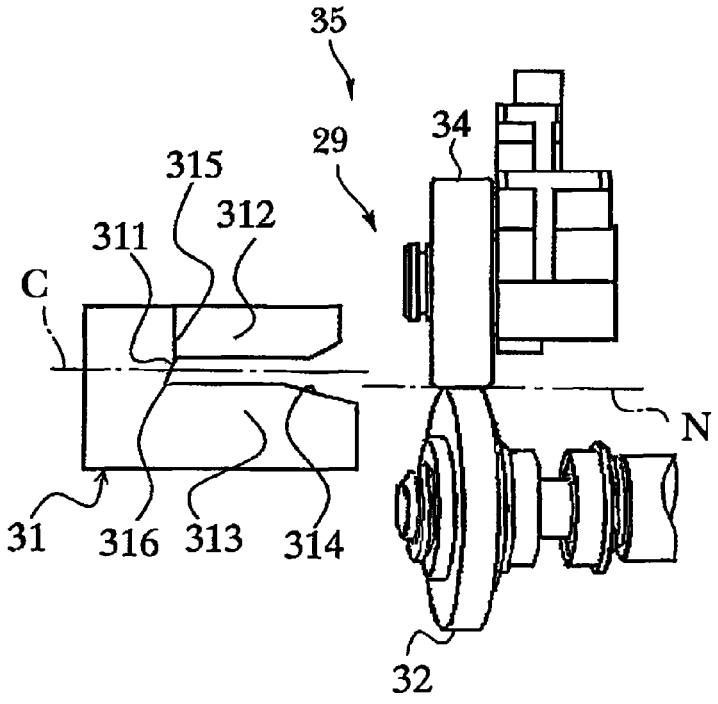
FIG. 7 is a side view illustrating a movable guide of a skew correction device according to a second embodiment of the present invention as viewed in the sheet conveying direction.

Specifically, in the second embodiment, the angle between the abutting reference surface 311 and the lower guide 313 at the corner portion 316, that is, the angle between the abutting reference surface 311 and a guide face of the lower guide 313 is set to an acute angle rather than a right angle as illustrated in FIG. 7. In the present embodiment, the angle is set to about 75 to 85[°]. If the angle at the corner portion 316 is set to be smaller than 75[°] and when a thick sheet having a sheet thickness of about 0.4 [mm] abuts the abutting reference surface 311, an error of 0.1 [mm] or more is caused at the abutting position as compared to the case where the abutting reference surface 311 is at a right angle. If the angle is set to 75[°] or smaller, the abutting reference position may be shifted in view of the error. In the present embodiment in which a structure with such an angle is adopted, a sheet S is less likely to be in contact with the abutting reference surface 311 in the direction of the joint 315 when the sheet S abuts the abutting reference surface 311. Accordingly, it is ensured that an edge portion of a sheet is prevented from being damaged or cut, and a sheet can be conveyed smoothly.

Third Embodiment

Figure 8:
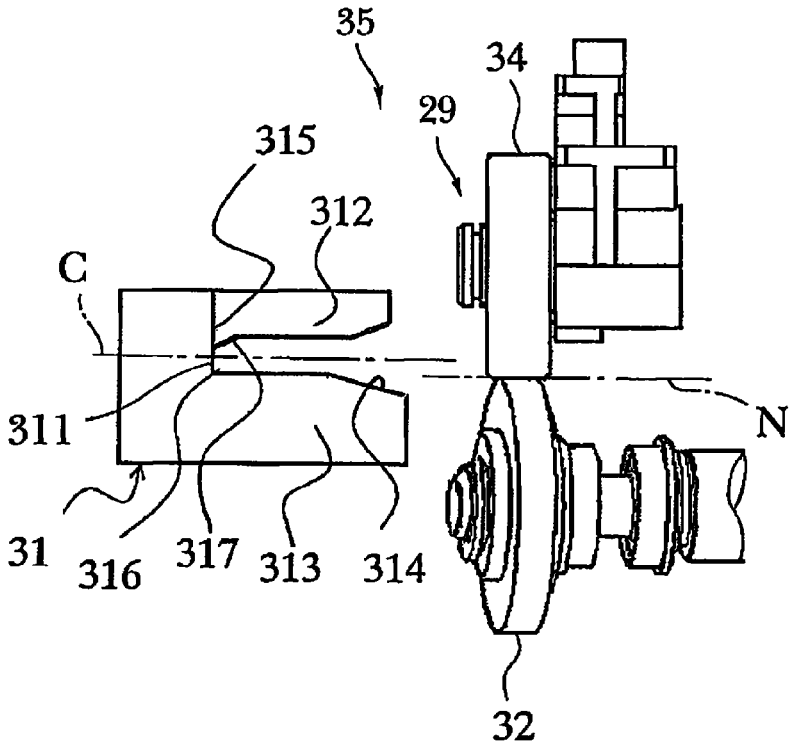
FIG. 8 is a side view illustrating a movable guide of a skew correction device according to a third embodiment of the present invention as viewed in the sheet conveying direction.
Figure 9:
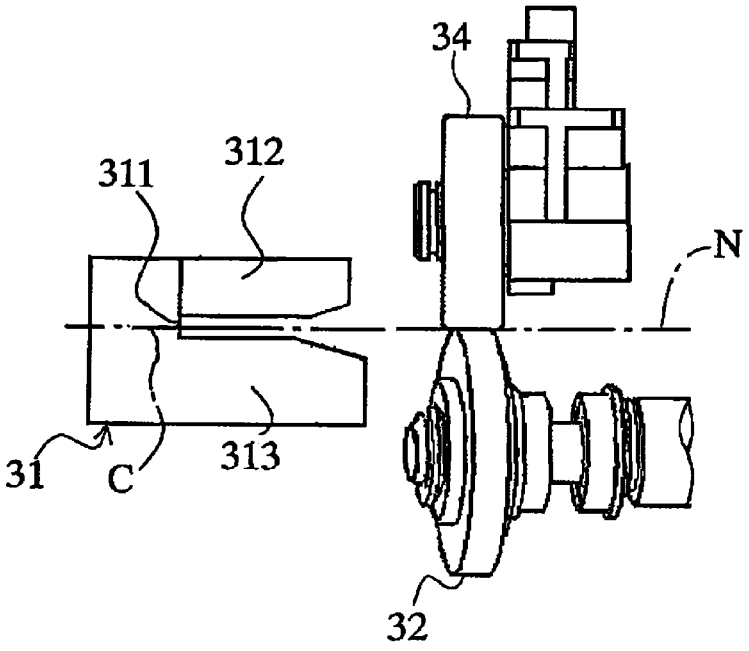
FIG. 9 PRIOR ART
FIG. 9 is a side view illustrating a part of a conventional skew correction device as viewed in the sheet conveying direction.
Figure 10:
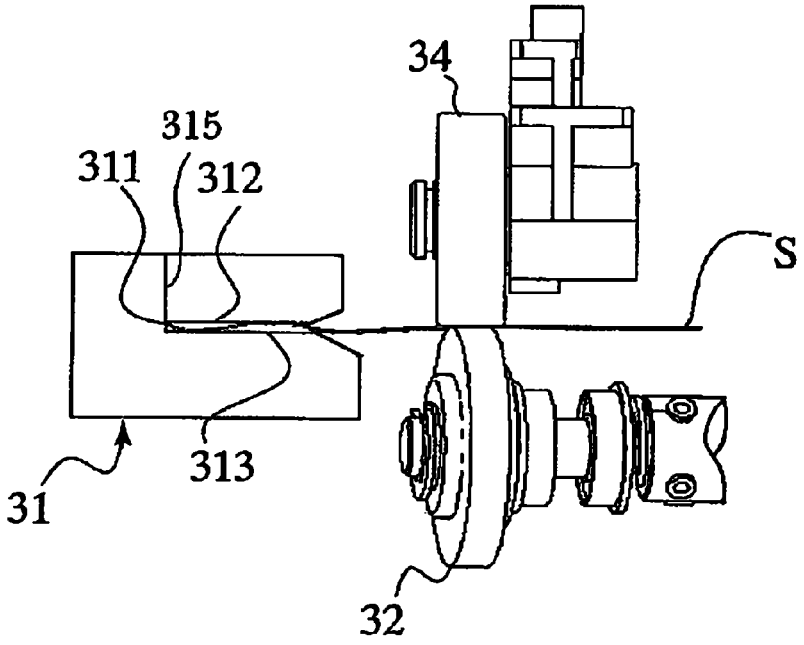
FIG. 10 PRIOR ART
FIG. 10 is a side view illustrating a part of another conventional skew correction device as viewed in the sheet conveying direction.
Figure 11:
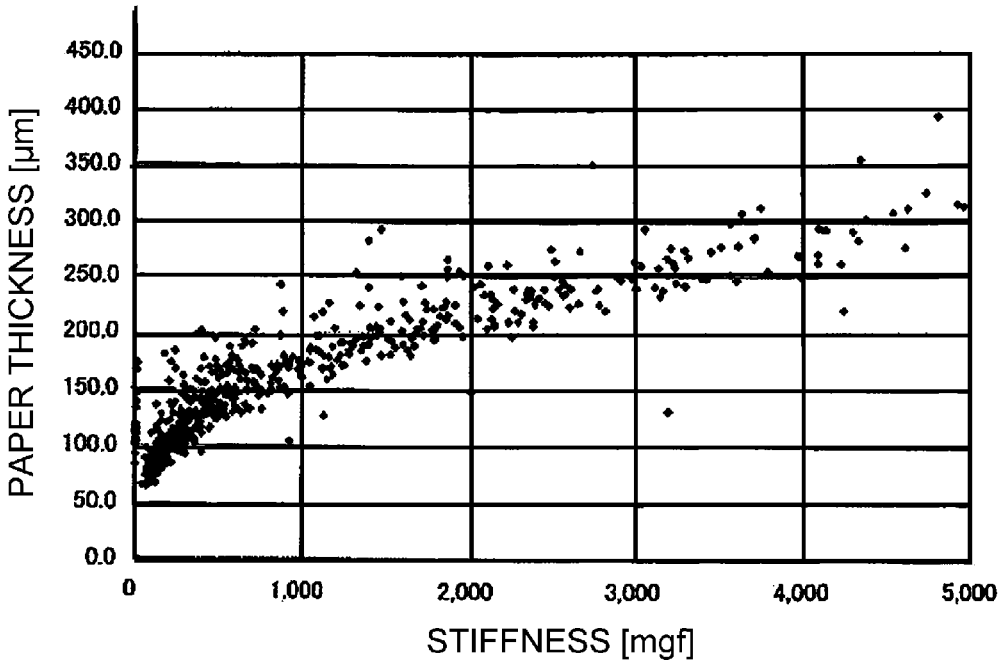
FIG. 11 PRIOR ART
FIG. 11 is a graph in which the relation between the sheet thickness and the stiffness of various materials is plotted.

Next, a third embodiment according to the present invention will be described with reference to FIG. 8. The third embodiment is different from the first embodiment only in the shape of the corner portion 316 and is substantially the same as the first embodiment in the remaining components. Accordingly, the same reference numbers are allotted to the same components and the description thereof will not be repeated.

In the third embodiment, a sheet S is less likely to be in contact with the joint 315 using a structure different from that in the second embodiment. Specifically, in the present embodiment, an inclined protrusion 317 is formed on the upper guide 312 in the vicinity of the abutting reference surface 311 as illustrated in FIG. 8. In other words, the angle between the guide face of the upper guide 312 and the abutting reference surface 311 is set to an obtuse angle. Therefore, when a sheet S is conveyed toward the abutting reference surface 311, the sheet S is curved downward along the inclined protrusion 317 and thus is further unlikely to be in contact with the abutting reference surface 311 in the direction of the joint 315. Accordingly, it is ensured that an edge portion of a sheet is prevented from being damaged or cut, and a sheet can be conveyed smoothly.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-200365, filed Aug. 31, 2009, which is hereby incorporated by reference herein in its entirety.

What is claimed is:

1. A sheet conveying apparatus comprising a skew correction portion which corrects skew feeding of a sheet passing on a sheet conveyance path, wherein the skew correction portion includes:

a reference guide portion which includes a skew correction reference surface extending in a sheet conveying direction, and a pair of guide members which are arranged above and below of the sheet conveyance path and guide a side edge of the sheet to the skew correction reference surface, wherein a gap portion between the pair of guide members is set wider than a thickness of a sheet conveyed by the sheet conveyance path; and a pair of obliquely feeding rollers which obliquely feed a sheet so that a side edge of the sheet comes in sliding contact with the skew correction reference surface, wherein one guide member of the pair of guide members is formed integrally with the skew correction reference surface and an other guide member of the pair of guide members is opposed to the one guide member, a joint between the pair of guide members is provided between the skew correction reference surface and the another of the pair of guide members so that a width of the gap portion between the pair of guide members is adjustable, the joint formed on a same plane as the skew correction reference surface, a positional relation of the pair of obliquely feeding rollers and the reference guide portion is set such that a nip line of a nip portion of the pair of obliquely feeding rollers is offset toward the one or the other of the pair of guide members with respect to a center line of the gap portion between the pair of guide members so that the nip line is outside the gap portion, and the one guide member of the pair of guide members has an inclined face which is intersected by the nip line of the pair of obliquely feeding rollers so as to be abutted by the side edge of the sheet fed by the pair of obliquely feeding rollers, wherein after the sheet fed by the pair of obliquely feeding rollers abuts the inclined face of the one guide member of the pair of guide members and is curved toward the other guide member of the pair of guide members by the inclined face, the sheet moves to the skew correction reference surface while in sliding contact with the other guide member of the pair of guide members and abuts the skew correction reference surface.

2. The sheet conveying apparatus according to claim 1, wherein an angle between the skew correction reference surface and the inclined face of the one guide member is an acute angle.

3. The sheet conveying apparatus according to claim 1, wherein an angle between a guide face of the another guide member and the skew correction reference surface is an obtuse angle.

4. An image forming apparatus comprising: a sheet conveying apparatus including a skew correction portion which corrects skew feeding of a sheet passing on a sheet conveyance path; and an image forming portion which forms an image on a sheet conveyed by the sheet conveying apparatus, wherein the skew correction portion includes:

a reference guide portion which includes a skew correction reference surface extending in a sheet conveying direction, and a pair of guide members which are arranged above and below of the sheet conveyance path and guide a side edge of the sheet to the skew correction reference surface, wherein a gap portion between the pair of guide members is set wider than a thickness of a sheet conveyed by the sheet conveyance path; and a pair of obliquely feeding rollers which obliquely feed a sheet so that a side edge of the sheet comes in sliding contact with the skew correction reference surface, wherein one guide member of the pair of guide members is formed integrally with the skew correction reference surface and an other guide member of the pair of guide members is opposed to the one guide member, a joint between the pair of guide members is provided between the skew correction reference surface and the another of the pair of guide members so that a width of the gap portion between the pair of guide members is adjustable, the joint formed on a same plane as the skew correction reference surface, a positional relation of the pair of obliquely feeding rollers and the reference guide portion is set such that a nip line of a nip portion of the pair of obliquely feeding rollers is offset toward the one or the other of the pair of guide members with respect to a center line of the gap portion between the pair of guide members so that the nip line is outside the gap portion, and the one guide member of the pair of guide members has an inclined face which is intersected by the nip line of the pair of obliquely feeding rollers so as to be abutted by the side edge of the sheet fed by the pair of obliquely feeding rollers, wherein after the sheet fed by the pair of obliquely feeding rollers abuts the inclined face of the one guide member of the pair of guide members and is curved toward the other guide member of the pair of guide members by the inclined face, the sheet moves to the skew correction reference surface while in sliding contact with the other guide member of the pair of guide members and abuts the skew correction reference surface.

5. The image forming apparatus according to claim 4, wherein an angle between the skew correction reference surface and the inclined face of the one guide member is an acute angle.

6. The image forming apparatus according to claim 4, wherein an angle between a guide face of the another guide member and the skew correction reference surface is an obtuse angle.

* * * * *